United States Patent [19]

Marshall

[11] 4,173,296

[45] Nov. 6, 1979

[54] APPARATUS FOR MIXING AND DISPENSING A BEVERAGE

[75] Inventor: William A. Marshall, Elmhurst, Ill.

[73] Assignee: Alco Foodservice Equipment Company, Miami, Fla.

[21] Appl. No.: 842,148

[22] Filed: Oct. 14, 1977

[51] Int. Cl.[2] ..... B67D 5/56

[52] U.S. Cl. ..... 222/129.1; 222/133; 251/117

[58] Field of Search ..... 222/1, 129.1, 129.3, 222/129.4, 133; 251/117

[56] References Cited

U.S. PATENT DOCUMENTS

| | | | |
|---|---|---|---|
| 1,238,051 | 8/1917 | Peterson | 251/117 X |
| 2,785,830 | 3/1957 | Bauerlein | 222/129.2 X |
| 3,118,648 | 1/1964 | Campbell | 251/117 X |
| 3,323,681 | 6/1967 | Di Vette et al. | 222/129.3 X |
| 3,640,434 | 2/1972 | Walker | 222/144.5 |
| 3,884,388 | 5/1975 | Holcomb | 222/132 |
| 3,898,861 | 8/1975 | McMillin | 222/1 X |

*Primary Examiner*—Francis J. Bartuska

*Attorney, Agent, or Firm*—Haight, Hofeldt, Davis & Jambor

[57] ABSTRACT

A device for mixing and dispensing a flow of liquid concentrated beverage ingredient from a constant volume pump with a pressurized diluent supplied from a source at a preselected flow rate through a flow control device. Diluent flow and liquid concentrate flow intersect and converge into a common fluid passageway which, in turn, flows into a fluid chamber formed by a housing. A tubular spout containing first and second restrictive orifices extends into the chamber formed by the housing and is sealed thereto by a pair of seal rings. The tubular spout can be rotated to a first or second position dependent upon the consistency of the liquid concentrate desired to be dispensed, thereby selectively permitting fluid to flow through the first orifice or both orifices. The unmixed diluent and liquid concentrate in the fluid chamber flow through the orifices and are mixed therein resulting in a homogeneous and uniformly mixed beverage. The mixed beverage is then diffused in the spout to substantially atmospheric pressure and very low flow velocity. The resultant diffused mixed beverage is then dispensed through the spout by gravity flow.

3 Claims, 7 Drawing Figures

APPARATUS FOR MIXING AND DISPENSING A BEVERAGE

BACKGROUND OF THE INVENTION

The present invention relates to devices for blending a concentrated beverage ingredient such as a fruit juice concentrate with a diluent such as water at a specified ratio and mixing the blend so as to produce a uniform homogeneous mixed beverage. Such devices are employed where it is desirable to store the beverage concentrate in bulk quantities and dispense the mixed beverage in individual servings.

Previous devices for diluting, mixing and dispensing a beverage concentrate have employed pressure regulators to control the flow of the diluent and constant volume pumps to provide a measured quantity of the concentrate. Blending, mixing and dispensing has been accomplished by intersecting streams of the concentrate and diluent and permitting the merged streams to diffuse to atmospheric pressure and thereafter swirling the merged streams in an enlarged flow area chamber to provide uniform mixing. An example of this type of mixing and dispensing is described in U.S. Pat. No. 3,884,388 to D. E. Holcomb. An example of a system utilizing a pressure regulator for controlling the flow of diluent in a mixed beverage dispensing system is described in U.S. Pat. No. 3,898,861 to J. R. McMillin. It is also known to provide a constant flow control device in the diluent line rather than using a pressure regulator as described in the copending application of Arthur Kulis, Ser. No. 740,920 filed Nov. 11, 1976, now abandoned and assigned to the assignee of the present invention.

In dispensers of the above-described type, the mixing of the concentrate ingredient and diluent occur at atmospheric pressure and low discharge velocities and, consequently, it is difficult to provide a uniform homogeneous mixed beverage. It has thus been desired to find a suitable technique for mixing the concentrate ingredient and diluent at higher velocities and pressures prior to diffusing the mixed beverage to atmospheric pressure and low velocity for dispensing.

SUMMARY OF THE INVENTION

The present invention provides a solution to the above-described problem of mixing a concentrated beverage ingredient and diluent by providing a unique arrangement of throttling the merged flow of concentrate and diluent through restrictive orifice means to effect mixing and then diffusing the mixed beverage to atmospheric pressure and lowered velocity.

The present invention employs a constant volume pump of the peristaltic type for receiving and delivering a predetermined quantity of the juice concentrate to a flow passage. Pressurized diluent water is supplied to a second flow passage through a constant rate flow control device which provides a specified rate of flow for a given inlet pressure. The concentrate and diluent passages are intersected and the merged flow is fed through a common flow passage. The flow through the common passage is throttled through restrictive orifice means to provide uniform and thorough mixing of the concentrate and diluent at the diluent line pressure and at increased velocities as the flow passes through the restrictive orifice means. Downstream of the restrictive orifice means a diffuser is provided to diffuse the thoroughly mixed beverage to substantially atmospheric pressure and lower flow velocities than encountered through the orifice means. A dispensing spout receives the mixed beverage at atmospheric pressure and dispenses the mixed beverage by gravity flow for individual servings.

The orifice means includes a selectively movable member, movable between a first position providing maximum restriction and throttling for mixing and a second position providing restriction and throttling of a lesser degree for mixing and dispensing beverages from concentrated ingredients of lesser viscosity and/or pulp content. For example, in the first position the orifice means dispenses a mixture of orange juice concentrate and water and in the second position the orifice means is sized to dispense mixed beverage of lesser concentrate density as, for example, tomato juice and water.

DETAILED DESCRIPTION

Figure 1:
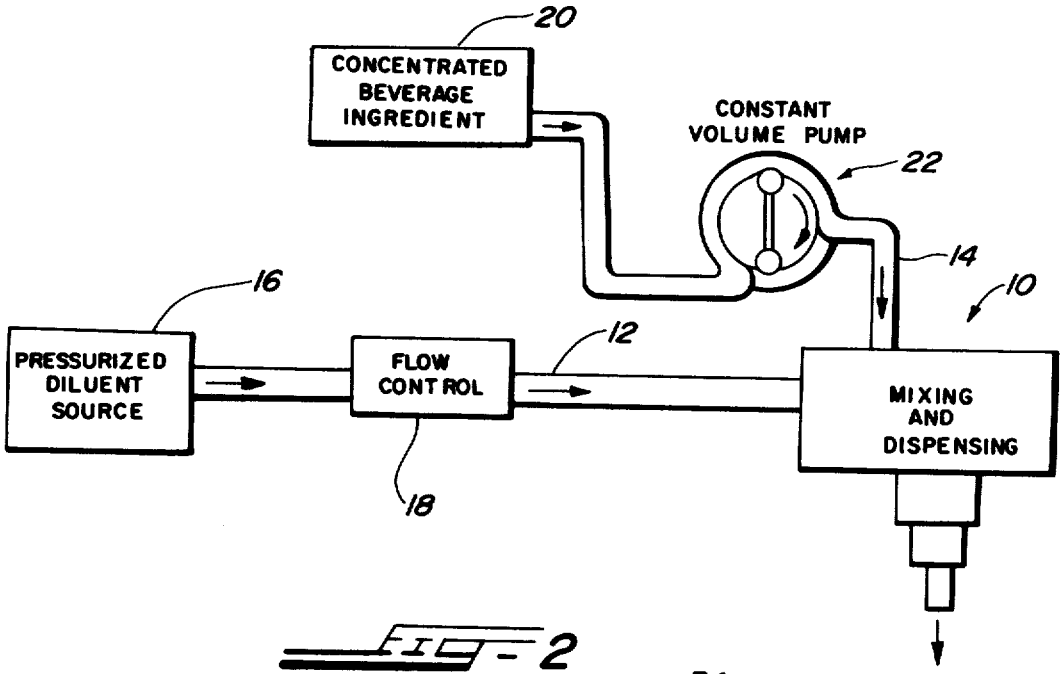
FIG. 1 is a schematic block diagram of the fluid flow of the dispenser of the present invention.

Referring now to FIG. 1, a mixing and dispensing assembly is shown generally by reference numeral 10 as being fed by fluid lines 12 and 14. The downstream end of fluid line 12 is connected to a pressurized diluent source 16. A flow control valve 18 connected along fluid line 12 and intermediate the mixing and dispensing assembly 10 and the diluent source 16 provides a constant and preferably adjustable, flow rate of diluent, independent of the magnitude of the pressure at the diluent source. Direction of flow within fluid lines 12 and 14 is indicated by black arrows. A source of liquid concentrated beverage ingredient 20 is connected to the inlet end of fluid line 14. A constant volume pump 22 is located along fluid line 14 and serves to pump the liquid concentrate 20 through line 14 and into the mixing and dispensing assembly. In the preferred practice of the invention, a peristaltic type pump has been found to be the optimal choice considering the low flow rate required and also the need to keep component costs at a minimum. In operation, the flow of the liquid concentrate through line 14 merges with a predetermined flow rate of diluent carried in line 12 where it is mixed and dispensed by mixing and dispensing assembly 10. It should be noted that constant volume pump 22 and flow control valve 18 are components well-known in the art and, as such, form no part of this invention. The operation of the device and details of the method for mixing the liquid concentrate with the diluent source will be subsequently described in greater detail.

Figure 2:
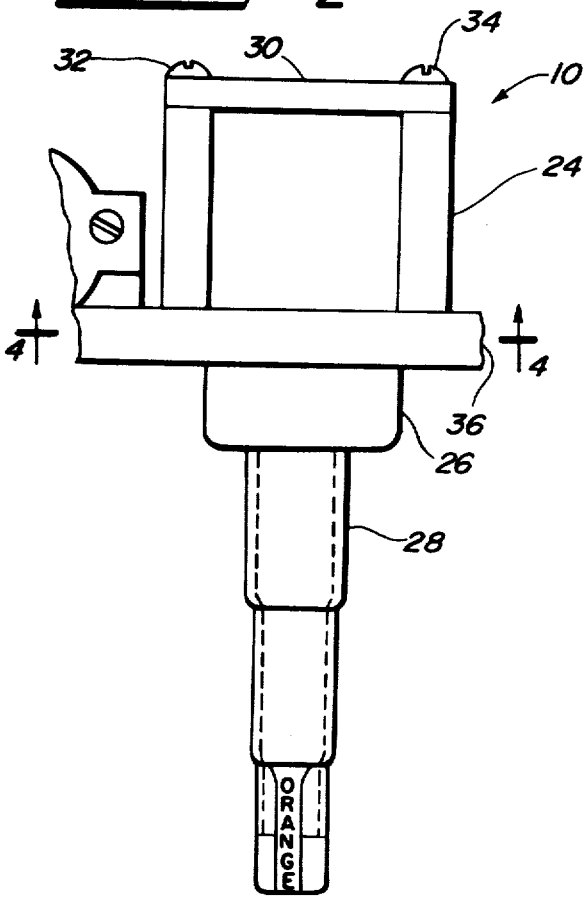
FIG. 2 is a front elevation view of the mixing and dispensing portion of the systems of FIG. 1.
Figure 3:
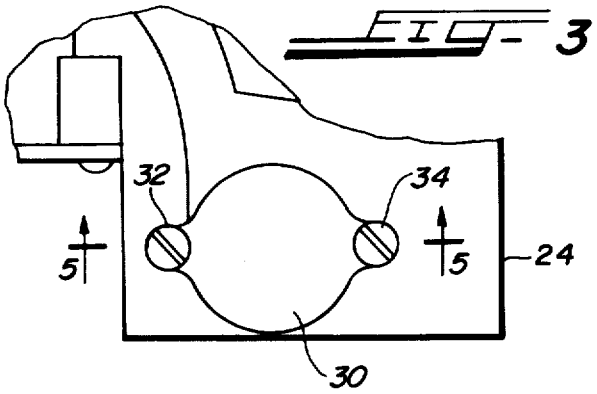
FIG. 3 is a plan view of a portion of the embodiment of FIG. 2.

As illustrated in FIG. 2, the mixing and dispensing unit includes an upper housing section 24, a lower housing section 26, and a spout 28. A cover plate 30 having a lower surface 31 shown in FIGS. 5, 6 and 7 sealingly engages with the upper housing section 24 and is secured in place by screws 32 and 34. A parting line 36 defines the junction of upper housing section 24 with lower housing section 26. In the preferred practice of the invention the spout, upper housing, and lower housing section are all formed from appropriate thermoplastic material. However, other materials can be used.

Figure 4:
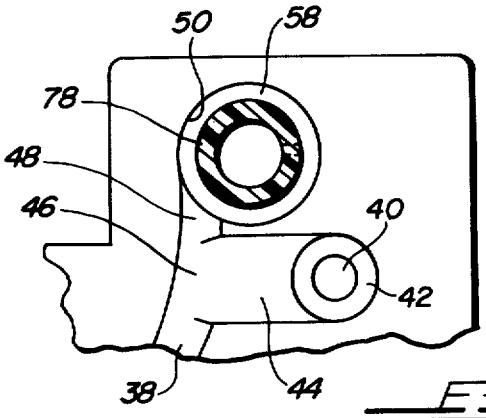
FIG. 4 is a partial section view taken along section indicating lines 4—4 of FIG. 2.

Referring now to FIG. 4, a passageway 38 formed in the upper housing section defines the fluid line 12 which carries the supply of pressurized diluent. The interconnection of passageway 38 with the diluent source is not shown. A bore 40 is formed in upper housing section 24 and provides a fluid passageway for the supply of liquid concentrate. A rim portion 42 is molded at the bottom of bore 40 and provides a seating and connecting surface for the supply of liquid concentrate (not shown). Bore 40 communicates with a fluid passageway 44 and merges with the stream of fluid carried by passageway 38 in the general area indicated by reference numeral 46. A common passageway 48 also formed in the upper housing section then serves to carry the substantially unmixed diluent and liquid concentrate into a bore 50. Bore 50 extends in a generally transverse direction from the paths defined by fluid passageways 38, 44 and 48 and can also be seen in FIG. 5 with the entry of passageway 48 indicated generally by reference numeral 52. With continued reference to FIG. 5, a bore 54 is formed in lower housing section 26 and is positioned with respect to upper housing 24 such that bores 50 and 54 are coaxially aligned. A bore 56, having an internal diameter less than bore 54, is formed in the upper portion of upper housing section 24. An elliptical shoulder 58 is then defined by the merging of bore 50 with bore 58. The plane or surface defined by FIG. 6 intersects the major axis of the elliptical shoulder 58, whereas the plane surface defined by FIG. 5 intersects the minor axis of the elliptical shoulder.

Figure 5:
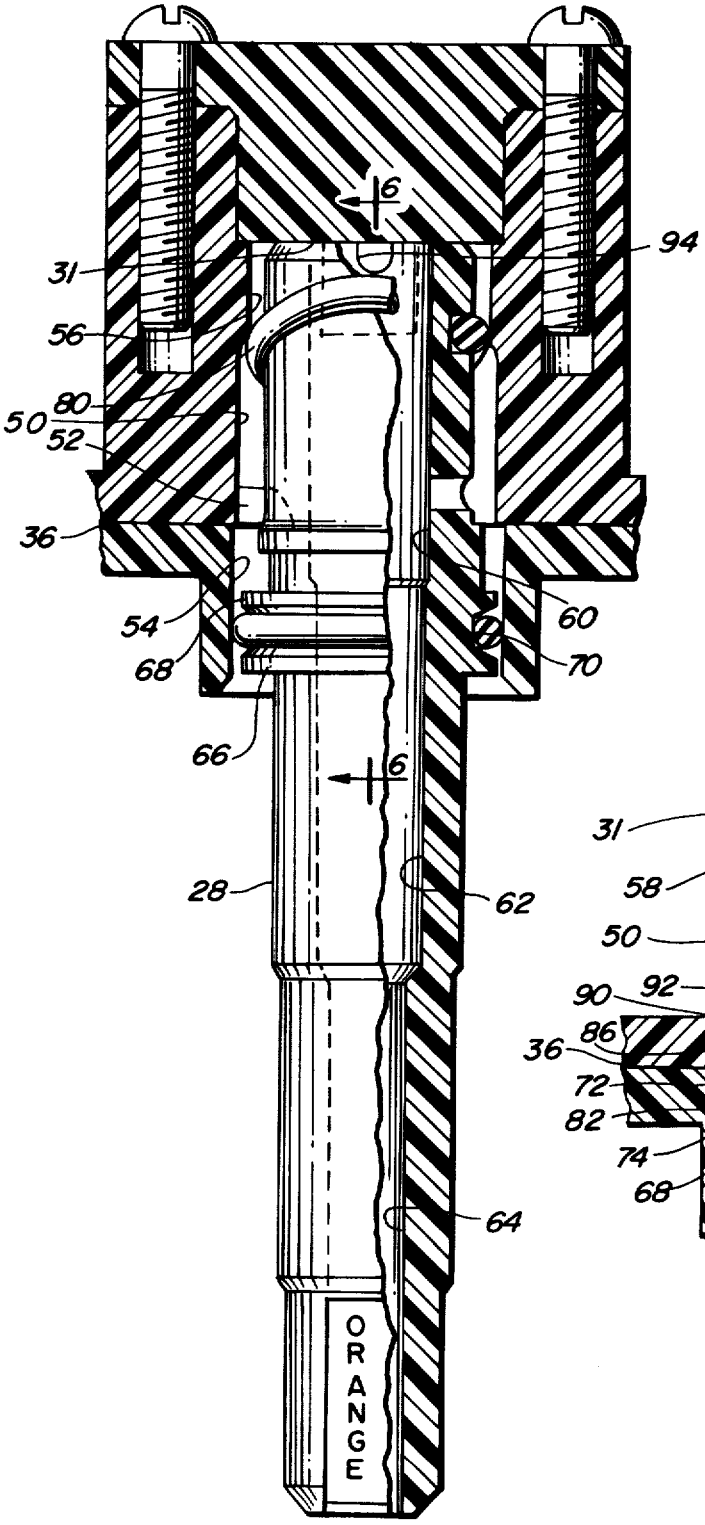
FIG. 5 is an enlarged section view taken along section indicating lines 5—5 of FIG. 3.
Figure 6:
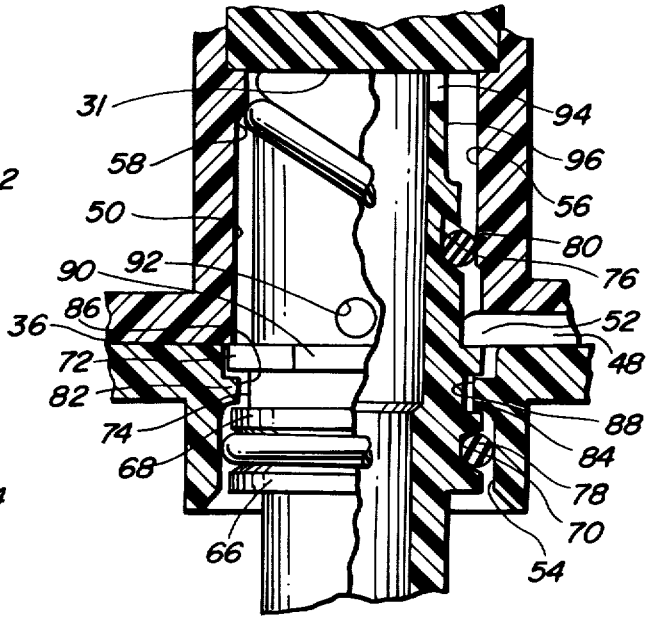
FIG. 6 is an enlarged portion of a section view taken along section indicating lines 6—6 of FIG. 5.

As illustrated in FIGS. 5 and 6, spout 28 has a generally tubular configuration defining an upper internal diameter 60, an intermediate internal diameter 62, and a lower internal diameter 64. Flanges 66 and 68 are formed around the outer periphery of the spout and define a groove 70. Another flange 72 together with flange 68 forms a groove 74. An elliptical groove 76 is formed near the upper end of the spout 28 and is contoured to match the elliptical pattern formed by shoulder 58. A seal ring 78 is located in groove 70 while a seal ring 80 is located in elliptical groove 76 and, in the preferred practice of the invention, are preferably formed from an elastomeric material. Internal ribs 82 and 84 are formed in lower housing section 26 and extend inward radially into bore 54 and define inner and opposite parallel surfaces 86 and 88 respectively. Surfaces 86 and 88 are parallel to the minor axis of elliptical shoulder 58. A flat surface 90 is formed on the flange 72. A similar flat surface 91 is positioned directly opposite and parallel surface 90 but is not shown in FIG. 6 but can be seen edgewise in FIG. 7. The planes defined by surfaces 90 and 91 are parallel to the major axis through the ellipse defined by elliptical groove 76. A first orifice 92, also designated as a first operative is formed immediately above flange 72 and is positioned in line with surface 90. A notch located along the upper edge of spout 28 defines a second orifice 94, also designated as a second operative, and is located 90° from orifice 92 in a direction toward the lower portion of elliptical groove 76. A flat surface 96 is formed tangentially with respect to second orifice 94 and extends downward to a level defined by the minor axis of elliptical groove 76.

In order to assemble the spout into bores 54 and 50, seal rings 78 and 80 must first be inserted in grooves 74 and 76, respectively. The tubular section is then rotated until surfaces 90 and 91 are parallel with surfaces 86 and 88. The spacing across surfaces 90 and 91 is less than the spacing across surfaces 86 and 88, thereby permitting the outer diameter of flange member 72 to clear ribs 82 and 84. Flange 68 locates the depth of the spout in the lower upper housing section by abutting against ribs 82 and 84. The spout is secured in place by simply rotating until flange 72 engages with ribs 82 and 84. Spout 28 is now fixed against axial movement by virtue of the entrapment of ribs 82 and 84 between ribs 72 and 68 thereby preventing further axial movement of the tubular spout, aside from the slight amount of movement resulting from allowance for clearance, but still permitting rotation of the spout. As best shown in FIG. 6, seal ring 78 is in sealing contact with bore 54 and groove 74. As shown in FIG. 6, seal ring 80 is in sealing contact with groove 76 and also the lower portion of bore 56 since the ellipse defined by seal ring 80 and shoulder 58 are in alignment. The spout, as shown by FIGS. 5 and 6, is defined as being in the first position. In this first position, the second orifice 94 is fluidly isolated from the first orifice 92 by seal ring 80.

Figure 7:
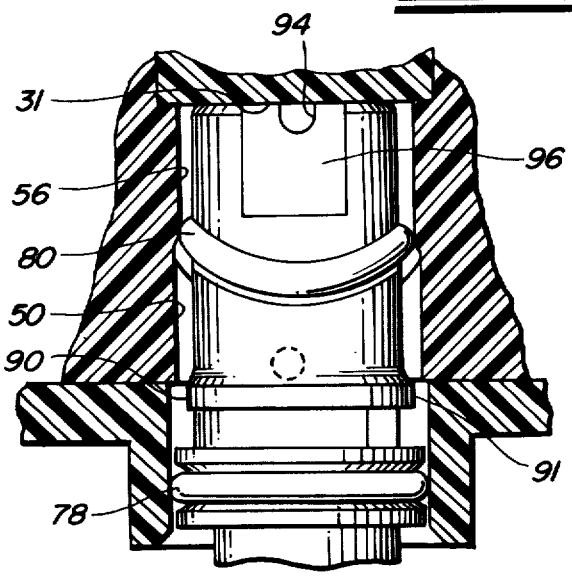
FIG. 7 is a view similar to FIGS. 5 and 6 and shows the rotary spout of FIG. 5 rotated 180° from the position shown in FIG. 5.

Referring now to FIG. 7, the spout has been rotated 180° to a second position in which seal ring 80 is approximately half-way disengaged from bore 56. The lower portion of seal ring 80 is disengaged from bore 56 permitting fluid to flow around seal ring 80, across flat surface 96 and through second orifice 94. The lower surface 31 of the cover is in close proximity to the upper end of spout 28 thereby causing flow to exhaust through second orifice 94.

The operation and effect of the mixing and dispensing unit in the first position will now be described. As illustrated by FIG. 4, the flow of liquid concentrate through passageway 44 and the flow of dilvent through passageway 38 intersects generally at a position defined by reference numeral 46 and then continues to flow through passageway 48. As best shown in FIG. 6, the substantially unmixed flow of diluent and liquid concentrate exits passageway 48 and enters the space between bore 50 and the outer diameter of the spout 28 immediately above flange 72 with seal rings 78 and 80 preventing further axial flow. The pressure generated by the constant volume pump and the pressurized diluent source, as reduced by flow control device 18, forces the fluid through the first restrictive orifice 92 whereby the throttling effect, well known to those skilled in the art, induces a turbulence within the fluid as it flows across the orifice, resulting in a homogeneous fluid and uniform mixing. At this point the fluid flow from the orifice enters the discharge passage of the spout defined by internal diameters 60, 62 and 64, is diffused and discharges under gravity feed through the lower end of spout 28. Orifice 92 has been sized to effect an optimum balance of mixing for a given concentration of liquid orange juice concentrate and flow of diluent water. It has been found the above-described arrangement of orifice size versus flow rate is particularly suited to dispensing orange drink. To facilitate operator selection of the proper spout position the word "orange" is molded into the lower outer surface of the spout as indicated in FIG. 5.

The mixing and dispensing cycle of the spout in the second position, as best illustrated in FIG. 7 will now be described. It has been found that liquid juice concentrate other than orange juice requires less orifice restriction in order to achieve a homogeneous and uniformly mixed beverage. Thus, in the second position, fluid flow is directed through both the first and second orifice 94. To position the spout in the second position the operator simply rotates the spout 180° away from the first position in either direction. In this position the lower half of seal ring 80 is disengaged from bore 56, thereby permitting fluid to flow between the gap defined by bore 50 and the outer periphery of seal ring 80. Flat surface 96 is now positioned in line with the upper portion of elliptical shoulder 58 and provides additional clearance between bore 56 to permit fluid to more easily flow to second orifice 94 as shown in FIG. 5. The bottom surface 31 of the cover plate 30 is in contact with the top edge of the spout 28 which causes substantially all of the fluid flow in the upper portion to exhaust or exit through the second orifice thereby achieving a mixing effect similar to that which simultaneously occurs through orifice 92.

Mixing and dispensing a concentrated beverage ingredient with a pressurized diluent supply can now be achieved in a more efficient manner and also with the feature of uniquely controlling the concentration of the resultant beverage. By merging the flow of liquid concentrate and diluent into a common down stream passage where the combined flow is then directed through a preselected orifice system, thorough mixing can be obtained without the need or use of complex mechanical or high pressure mixing systems or pre-mixing liquid concentrate with diluent requiring additional hydraulic circuitry.

It will be obvious to those having ordinary skill in the art that modifications of the invention can be made without departing from the essence and spirit of the invention as shown and described above. It is intended that the breadth and scope of the invention be limited only by the following claims.

What is claimed is:

1. A device for mixing a concentrated beverage ingredient and a diluent and dispensing a mixed beverage, said device comprising:

(a) means operative to provide, upon connection to a source of beverage concentrate, a measured flow of said concentrate;

(b) means operative to provide, upon connection to a source of pressurized diluent, a controlled flow of said diluent;

(c) means defining a first flow passage receiving said diluent flow therethrough and defining a second flow passage receiving said concentrate flow therethrough, wherein said first and second passages intersect to form a common flow passage for said diluent and concentrate;

(d) dispensing means receiving said flow from said common passage, said dispensing means including:

(i) housing means defining a bore;

(ii) a tubular member movably received in said bore;

(iii) mixing orifice means including first and second orifices communicating with the interior of said tubular member and operative to restrict said flow to an effective flow area substantially less than the flow area of said common passage and to effect mixing of said concentrate and diluent to form a homogeneously mixed beverage, said orifice means including means selectively movable between a first position providing a first effective orifice flow area and a second position providing a second effective orifice flow area greater than said first effective orifice flow area, said selectively movable means including seal means operative to seal between the outer periphery of said tubular member and the inner periphery of said bore in said first position to prevent flow through said second orifice, and operative in said second position to permit flow through said first and second orifices; and, (iv) diffuser means comprising the interior of said tubular member and receiving all flow of said mixed beverage from said mixing orifice means, said diffuser means being operative to diffuse said flow from said orifice means to substantially atmospheric pressure and to a substantially lower velocity than the velocity through said orifice means, said diffuser means including spout means receiving said diffused flow of mixed beverage, said spout means being operative to discharge said mixed beverage by gravity flow.

2. A device as claimed in claim 1 wherein said tubular member is rotated in said bore to selectively provide desired effective flow area.

3. A device for homogeneously mixing a flow of diluent with a flow of liquid concentrate, said device comprising:

(a) a housing means, said housing means including, (i) an upper housing section defining a first bore having a first internal diameter, and a second bore having a second internal diameter, said first internal diameter being greater than said second internal diameter, said first and second bores meeting to form a shoulder located in a first plane angularly off-set from a reference plane perpendicular to a longitudinal axis through said first and second bores;

(ii) a lower housing section defining a third bore and having first and second ribs extending inward radially from said bore, said ribs having first and second opposed parallel surfaces spaced a first distance;

(iii) said upper housing further defining fluid passageway means for conveying said diluent and said liquid concentrate into said housing means;

(b) a tubular member having a longitudinal bore, said tubular member partially extending into said upper and lower housing sections and having first and second rotatable positions in said housing;

(c) a first restrictive orifice means located on said tubular member;

(d) a second restrictive orifice means located on said tubular member;

(e) a flange, having a diameter greater than said first distance between said first and second surfaces, formed around said tubular member and having third and fourth flat, parallel surfaces spaced a second distance less than said first distance thereby permitting said tubular member to be inserted into said housing such that said flange extends axially beyond said first and second ribs in said housing, whereupon rotation of said tubular member said flange rotates over said first and second ribs for retaining said tubular member within said housing; and (f) said tubular member including first and second spaced seal means such that said first restrictive orifice means is located between said first and second seal means and said second restrictive orifice means is located above said first and second seal means, said second seal means is located in a second plane angularly off-set from a reference plane perpendicular to a longitudinal axis through said tubular member, in which first and second positions said first seal means is in sealing contact with said third bore, in which first position said second seal means is aligned with and above said shoulder for achieving complete sealing contact with said second bore and for fluidly isolating said first restrictive orifice means from said second restrictive orifice means and for permitting said diluent and said liquid concentrate flow to pass through said first restrictive orifice means whereupon said diluent and said liquid concentrate are homogeneously mixed and diffused into said longitudinal bore of said tubular member, and in which second position said second seal means is misaligned from said shoulder and partially unseated from said second bore for permitting fluid flow through said second restrictive orifice means whereupon said diluent and said liquid concentrate flow pass through said first and second restrictive orifice means whereupon said diluent and said liquid concentrate are homogeneously mixed and diffused into said longitudinal bore of said tubular member, said device thereby permitting one of two levels of mixing to be selected.

* * * * *